US006861988B2

(12) United States Patent
Gabriel et al.

(10) Patent No.: US 6,861,988 B2
(45) Date of Patent: Mar. 1, 2005

(54) PATCH ANTENNA FOR OPERATING IN AT LEAST TWO FREQUENCY RANGES

(75) Inventors: Roland Gabriel, Griesstatt (DE); Carsten Schultheiss, Holzkirchen (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/450,049

(22) PCT Filed: Dec. 13, 2001

(86) PCT No.: PCT/EP01/14688

§ 371 (c)(1),
(2), (4) Date: Jun. 10, 2003

(87) PCT Pub. No.: WO02/50940

PCT Pub. Date: Jun. 27, 2002

(65) Prior Publication Data

US 2004/0027292 A1 Feb. 12, 2004

(30) Foreign Application Priority Data

Dec. 21, 2000 (DE) ..... 100 64 128

(51) Int. Cl.[7] ..... H01Q 1/38
(52) U.S. Cl. ..... 343/700 MS; 343/846
(58) Field of Search ..... 343/700 MS, 767, 343/770, 846, 848, 853

(56) References Cited

U.S. PATENT DOCUMENTS 5,323,168 A 6/1994 Itoh et al. ..... 343/700 MS
5,448,250 A * 9/1995 Day ..... 343/700 MS (List continued on next page.)

FOREIGN PATENT DOCUMENTS

EP 0 433 255 A2 6/1991
EP 0 521 384 A1 1/1993

(List continued on next page.)

OTHER PUBLICATIONS

Song et al; "Ku–Band 16×16 Planar Array with Aperture–Coupled Microstrip–Patch Elements"; IEEE Antennas and Propagation Magazine, vol. 40, No. 5, Oct. 1998, pp. 25–29.

(List continued on next page.)

*Primary Examiner*—Tan Ho
(74) *Attorney, Agent, or Firm*—Nixon & Vanderhye P.C.

(57) ABSTRACT

An improved patch antenna for operation in at least two frequency bands is distinguished by the following features:

having a reflector (1), at least two patch antenna element arrangements (5, 7) are provided, constructed on the reflector (1) and/or arranged in front of the reflector (1), namely a patch antenna element arrangement (5) for a lower frequency band and a patch antenna element arrangement (7) for a higher frequency band, the patch antenna element arrangements (5, 7) for the lower frequency band and for the higher frequency band each have at least one active feed patch (5*a*, 7*a*) with an associated slot structure (11, 13) and a passive cover patch (5*b*, 7*b*), which is arranged above it and is capacitively coupled, the patch antenna element arrangements (5, 7) for the lower frequency band and for the higher frequency band located on a base plate, the top cover patch (5*b*) of the lower patch antenna element arrangement (5) for the lower frequency band in this case at the same time forms the base plate for a patch antenna element arrangement (7), which is constructed on it, for the higher frequency band, a slot arrangement which has an H-shaped slot structure (11, 13) is formed in at least one feed patch (5*a*, 7*a*), and the at least two slot structures (11, 13) in the respective feed patch (5*a*, 7*a*) are fed via a respectively associated feed cable arrangement (15*a*, 15*b*).

20 Claims, 4 Drawing Sheets

U.S. PATENT DOCUMENTS

| | | | | | |
|---|---|---|---|---|---|
| 5,661,493 | A | * | 8/1997 | Uher et al. | 343/700 MS |
| 6,018,320 | A | * | 1/2000 | Jidhage et al. | 343/700 MS |
| 6,054,953 | A | * | 4/2000 | Lindmark | 343/700 MS |
| 6,087,990 | A | | 7/2000 | Thill et al. | 343/700 MS |
| 6,198,439 | B1 | | 3/2001 | Dufrane et al. | 343/700 MS |
| 6,211,824 | B1 | * | 4/2001 | Holden et al. | 343/700 MS |
| 6,351,239 | B1 | * | 2/2002 | Mizuno et al. | 343/700 MS |
| 6,639,558 | B2 | * | 10/2003 | Kellerman et al. | 343/700 MS |

FOREIGN PATENT DOCUMENTS

| | | | |
|---|---|---|---|
| EP | 0 740 361 | A1 | 10/1996 |
| EP | 0 999 608 | A1 | 5/2000 |
| EP | 1 069 646 | A2 | 1/2001 |
| WO | 99/59223 | | 11/1999 |
| WO | 00/13260 | | 3/2000 |

OTHER PUBLICATIONS

Lindmark; "A Dual Polarized Dual Band Microstrip Antenna for Wireless Communications"; Allgon System AB, Aerospace Conference, Mar. 21–28, 1998 IEEE, vol. 3, pp. 333–338.

Pischke et al; "Supraleitende Miniaturisierte Planarantennen"; Radio Fernsehen Elektronik, VEB Verlag Technik. Berlin, DE, vol. 41, No. 2, 1992, pp. 101–104, XP000288670.

Rahti, V. et al; "Improved Coupling for Aperture Coupled Microstrip Antennas"; IEEE Transactions on Antennas and Propagation, vol. 44, No. 8, Aug. 1996, pp. 1196–1198.

Sainati, Robert A., "CAD of Microstrip Antennas for Wireless Applications," pp. 150–159.

* cited by examiner

PATCH ANTENNA FOR OPERATING IN AT LEAST TWO FREQUENCY RANGES

This application is the US national phase of international application PCT/EP01/14688 filed 13 Dec. 2001, which designated the US.

The invention relates to a patch antenna for operation in at least two frequency bands, as claimed in the precharacterizing clause of claim 1.

It has been known for a long time that various frequency bands are available for transmitting information in the mobile radio band, specifically, for example, the 900 MHz band as well as the 1800 MHz band in the European area. Particularly in the USA area, mobile radio transmission uses the so-called 1900 MHz band. The 2000 MHz band has been provided for the future planned UMTS Standard.

Apart from known dipole antennas, which can be operated in two frequency bands, antennas of a planar type, namely so-called patch antennas, are also known in principle.

In principle, EP 0 999 608 A1 has also disclosed a patch antenna which, as a multifunction antenna, has two or more patch antenna elements which are arranged above a ground plane or a reflector and are designed for receiving appropriate electromagnetic waves for position data detection from geostationary satellites (GPS). The patch antenna elements are in this case constructed above a common ground plane.

A patch antenna of this generic type has been disclosed in Patent Specification U.S. Pat. No. 6,054,953. This has a base plate. A patch for transmitting the lower frequency band is arranged above the base plate, and a further patch is arranged above this, for transmission in the higher transmission band. The patch for transmission in the lower frequency band is at the same time used as an active feed patch for the patch which is located above it for transmission of the higher frequency band. The feed is provided via a common cruciform slotted structure in the base plate. In order to improve the coupling, a passive coupling patch is also arranged between the feed point in the base plate and the patch for transmission of the lower frequency band.

The electrical characteristics of an antenna such as this also have disadvantages, however, since the desired bandwidth cannot be achieved.

Patch antennas are otherwise also known in principle from the citation "SONG, H. J. et al.: Ku-Band 16×16 Planar Array with Aperture-Coupled Microstrip-Patch Elements. In: IEEE Antennas and Propagation Magazine, Vol. 40, No. 5, October 1998, pages 25 to 29" and from the citation "RATHI, V. et al.: Improved Coupling for Aperture Coupled Microstrip Antennas. In: IEEE Transactions on Antennas and Propagation, Vol. 44, No. 8, August 1996, pages 1196 to 1198", which describe different slot recesses for feeding. However, the slot recesses are in this case used for the aperture coupling between the feed line and the patch.

The object of the present invention is to provide a patch antenna for operation in at least two frequency bands, which is designed to be as flat as possible, has a very wide bandwidth, and at the same time has as good a transmission characteristic as possible.

The object is achieved according to the invention by the features specified in claim 1. Advantageous refinements are specified in the dependent claims.

In principle, the patch antenna according to the invention can be operated in at least two frequency bands. The design principle can also be extended such that the antenna is equally suitable for having the capability to operate in more than two frequency bands, for example in three frequency bands. In this case, the overall structure is kept very flat, with the antenna according to the invention also having an excellent antenna characteristic.

For this purpose, the invention provides that the at least two patch antenna element arrangements are arranged constructed one on top of the other on a reflector, with each patch antenna element arrangement having at least one active feed patch and, located above it, a capacitively coupled passive cover patch. An upper cover patch for the lower frequency band in each case is in each case at the same time used as a base plate for the feed patch for the respective higher frequency band. Furthermore, provision is made for a separate feed to be provided for each frequency band.

According to the prior art, it is known for a feed to be provided at a rectangular slot in a feed patch, with the outer conductor of the coaxial cable making electrical contact on one side of the slot, and the inner conductor being passed centrally and transversely with respect to the slot arrangement beyond this, and making contact with the patch on the opposite edge face of the slot. The invention provides for the patch antenna element to have an at least approximately H-shaped slot structure, or at least comprise an H-shaped slot structure. It has been found that this makes it possible to improve the beam characteristic and to increase the bandwidth.

One preferred embodiment of the invention provides for the cable feed to be attached preferably centrally to each active antenna element patch, with the cable being routed in front of the feed point, that is to say preferably centrally from the feed patch to ground, that is to say centrally down over the edge of the respective feed patch to the reflector plate.

One development of the invention provides for a rectangular bracket to be provided on at least one of the patch antenna elements, preferably on the feed patch area which is located at the top, in the area of the central slot recess in the H-shaped slot, in order to improve the matching (VSWR) and to increase the bandwidth. At least a part of the length of one limb covers the central slot of the H-shaped slot structure at a distance from it and parallel to it, with the vertical limb being passed back at right angles to the feed patch where it is secured, to be precise on the edge area of the central slot recess.

In one preferred development of the invention, or in an alternative refinement of the invention, a solution has been found in a highly surprising manner that makes it possible to further reduce the water sensitivity of the antenna. This is done by cutting out a part of the surface in the system deck patch which is located at the top and is tuned to the highest frequency. In consequence, a cover patch structure in the form of a frame is thus normally preferable.

Finally, the physical height can be further minimized by integrating the feed patch of the respective higher frequency system in the cover patch of the lower system. For this purpose, a part of the cover patch for the lower frequency can be cut out, with the feed patch being inserted into this cutout.

However, as an alternative to this, it is also possible to design the cover patch for a lower frequency to be in the form of a trough, in which case the feed patch for the higher frequency system can then be inserted into this shape in the form of a trough.

As has already been mentioned, the feed systems are each fed separately by one feed cable, so that each of the two systems has a separate connection. However, the separate feed cables may also be joined together via a duplexer, which is integrated in the antenna, or via a cable network, so that the entire antenna is provided with a single connection.

The frequency ratio of the patch antenna elements may, for example, be 1:2, dependent on the desired frequency band for the antenna.

Provision is preferably made for the base plate of the patch antenna element arrangement for the lowest frequency band to be formed by the reflector. However, in this case, it is also possible to provide a base plate which is seated on the reflector or in front of the reflector, but which then likewise once again acts as a type of reflector.

Finally, supplementary measures in order to achieve better decoupling between the patch antenna elements which are tuned to different bands can be provided, to be precise using spur lines which are connected in parallel with the respective connecting line.

The invention will be explained in more detail in the following text using exemplary embodiments. In this case, in detail:

Figure 3A:
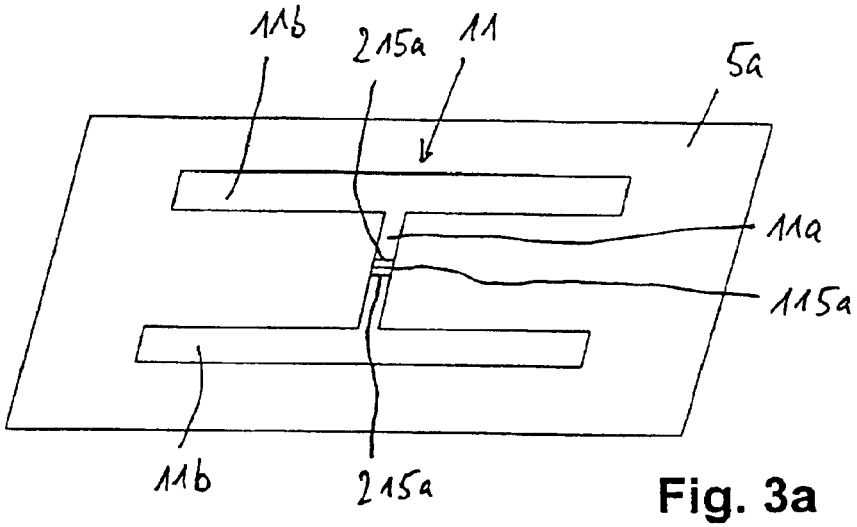
Figure 3B:
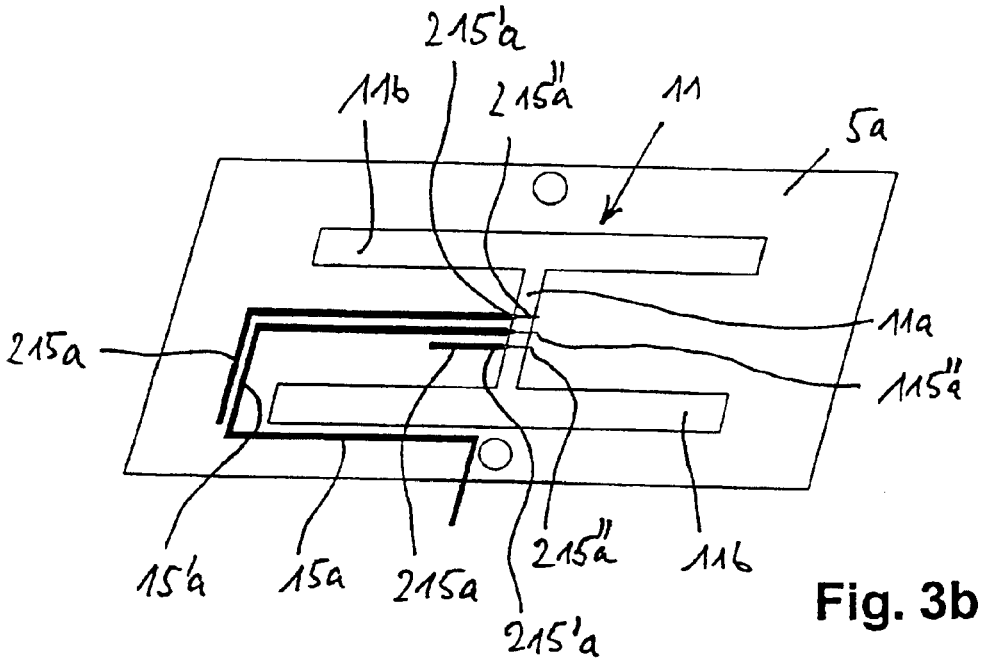

FIG. 3*a* shows a plan view of the active feed patch of the patch antenna element which is provided for the lower frequency band;

FIG. 3*b* shows a corresponding view from underneath the feed patch shown in FIG. 3*a;*

Figure 2:
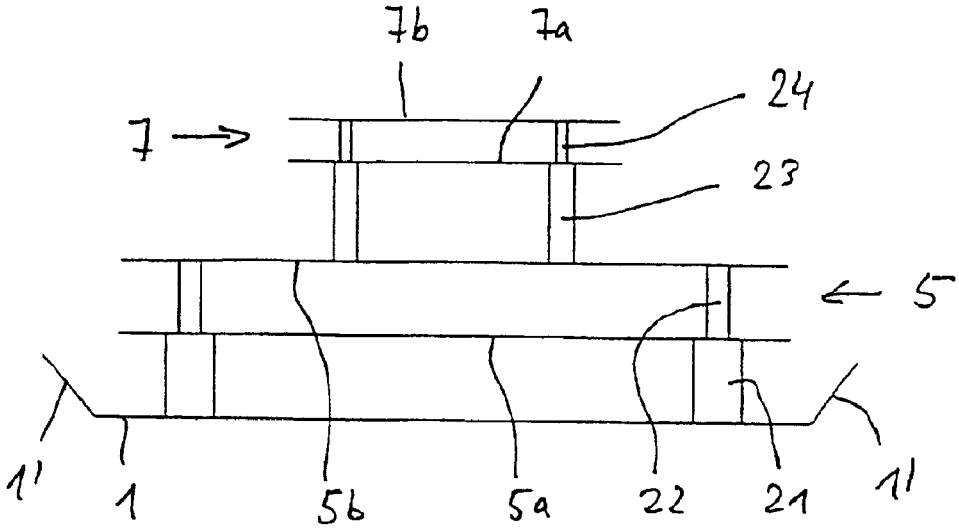
FIG. 2 shows a cross-sectional illustration through the exemplary embodiment shown in FIG. 1, in the area of the individual supporting elements.
Figure 4:
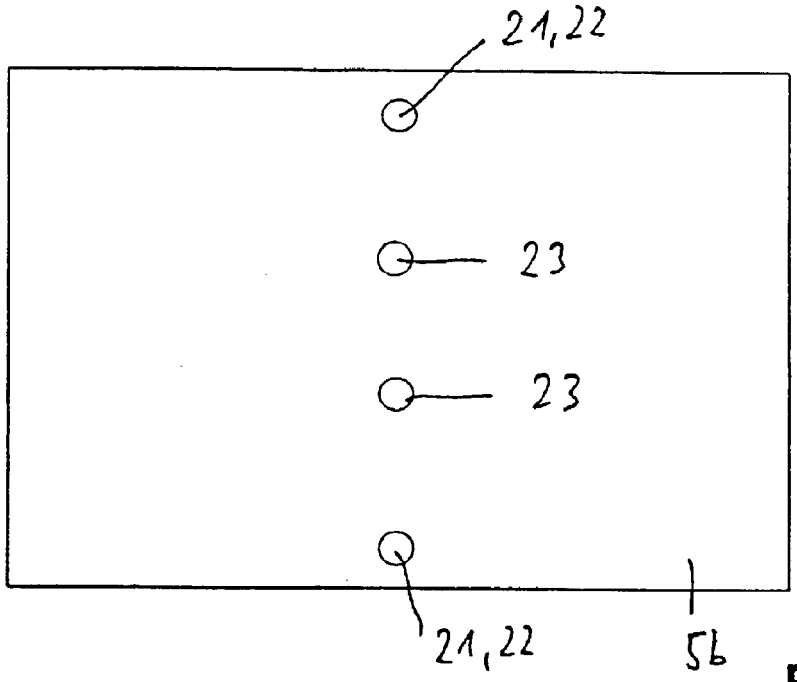
Figure 5A:
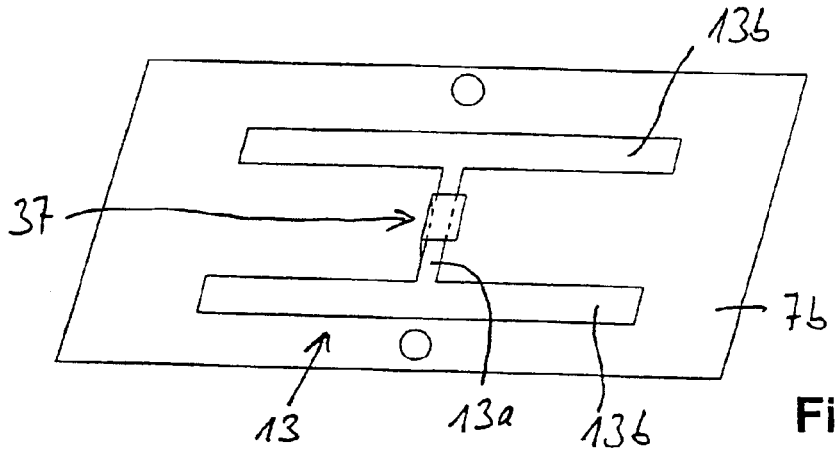
Figure 5B:
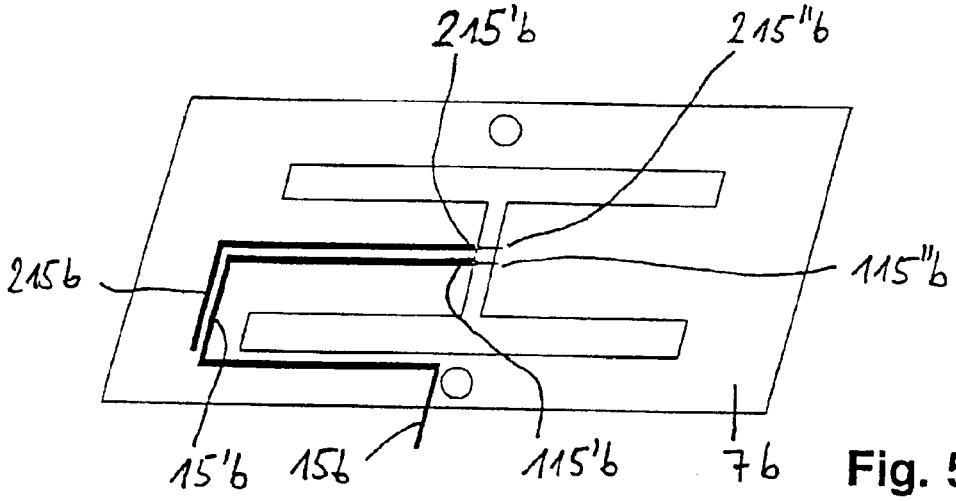
Figure 6:
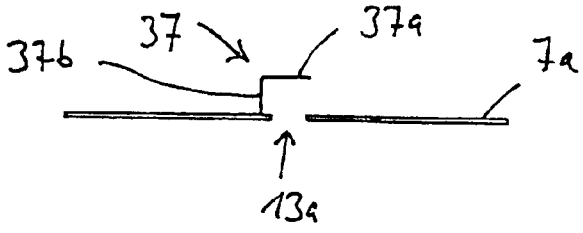

FIG. 4 shows a plan view of the cover patch for the lower patch antenna element;

FIG. 5*a* shows a plan view of the feed patch of the patch antenna element arrangement which is provided for the higher frequency band;

FIG. 5*b* shows a view from underneath of the feed patch shown in FIG. 5*a*; and FIG. 6 shows a vertical section illustration, rotated through 90° in comparison to FIG. 2, through the upper feed patch.

Figure 1:
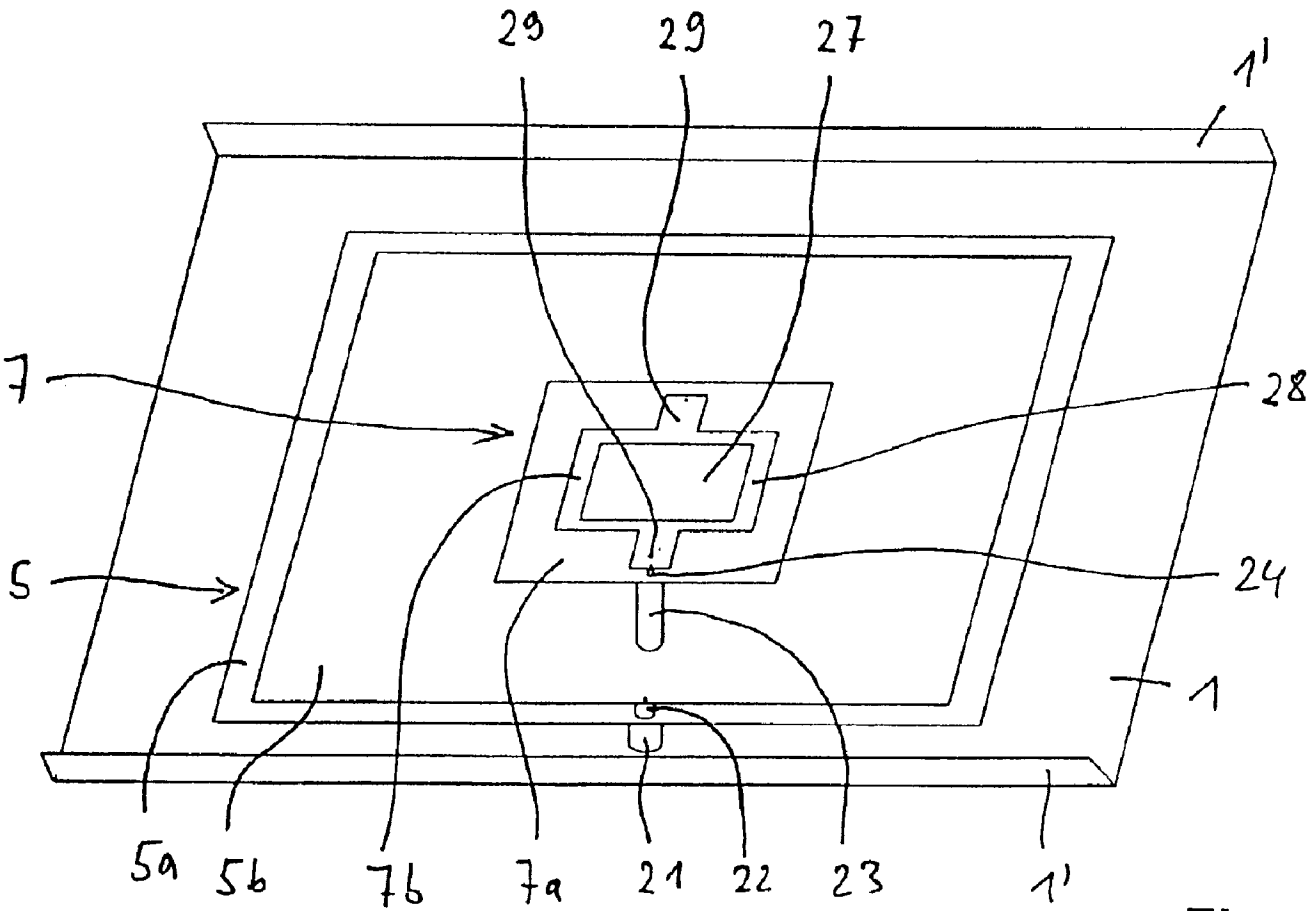
FIG. 1 shows a schematic perspective illustration of a patch antenna according to the invention.

FIG. 1 shows a schematic perspective illustration of the entire structure of the antenna with a reflector plate, that is to say a reflector 1 which, in the illustrated exemplary embodiment, is provided with an end strip 1', which is formed on two opposite longitudinal edges and extends essentially transversely or at right angles to the reflector plate plane.

In the illustrated exemplary embodiment, two patch antenna element arrangements are provided constructed on this reflector 1, namely a first patch antenna element arrangement 5 for the lower frequency band, for example for the GSM frequency band (870–960 MHz), and a physically smaller further patch antenna element arrangement 7, which is once again constructed on it, for a higher frequency band, for example for the PCN and UMTS frequency band (1710 MHz, 2170 MHz etc).

Each of the two patch antenna element arrangements 5 and 7 is constructed in the form of a double patch antenna element arrangement, to be precise each having an active feed patch 5*a* or 7*a*, respectively, and a respective cover patch 5*b* or 7*b*, which is located above it, is coupled only capacitively and is therefore passive.

FIGS. 3*a* and 3*b* show the physically larger feed patch 5*a* which is provided for the lower frequency band. It can be seen from this that the feed patch is in the form of a rectangular plate, in which an H-shaped slot structure 11 is incorporated. The central slot 11*a* in this case extends in the transverse direction of the reflector 1, that is to say transversely with respect to the edge strip 1' of the reflector 1 in the illustrated exemplary embodiment. Parallel slots 11*b*, which run continuously on both sides, are incorporated at the ends of this central slot 11*a*, transversely with respect to it. As can be seen in particular in the view from underneath shown in FIG. 3*b*, the cable feed for this feed patch 5*a* is provided separately via a coaxial feed cable 15*a*, which is laid such that it runs on the reflector 1, that is to say in particular along its edge strip 1', and then centrally to the edge of the feed patch 5*a*, and from there in the direction of the H-shaped slot structure 11. In this case, the cable is preferably at least approximately laid as a coaxial extension to the central slot 11*a* on the lower face in the direction of the central slot 11*a*, and then in a V-shaped or U-shaped loop 15'*a* around the end of the initially horizontal parallel slot 11*b*. The coaxial cable then preferably ends in the center of the central slot 11*a* on one side of the slot recess, where the outer conductor 115*a* makes electrical contact. The inner conductor 115*b* is routed beyond this, transversely with respect to the longitudinal extent of the central slot 11*a*, and makes electrical contact with the feed patch on the opposite side of the central slot.

As can be seen from the sketch shown in FIGS. 3*a* and 3*b*, two further spur lines 215*a* are also provided in addition to the actual feed cable 15*a*, namely on the left and right in a length element of the actual feed cable 15*a*, with the spur lines 215*a* having different lengths. Each of the two spur lines is thus arranged parallel at least to the end section of the feed cable 15*a* such that the respective inner conductor 215"*a* bridges the central slot 11*a* parallel to the inner conductor 115"*a* of the feed cable 15*a*, and makes electrical contact with the patch on the opposite side of the slot 11*a*, with the outer conductor 215'*a* of the respective spur line 215*a* making electrical contact with the patch in front of the slot.

The feed patch 5*a* is mounted on the reflector 1 by means of two side spacers 21, which are in the form of columns and are not conductive, and the cover patch 5*b* which is located above it is mounted via an axial spacer 22, whose transverse dimensions are approximately the same, with the longitudinal dimensions typically being shorter.

The further patch antenna element arrangement 7 is now constructed on this cover patch 5*b* for the lower patch antenna element arrangement 5, and is likewise in the form of a double patch arrangement with a feed patch 7*a* and a cover patch 7*b* covering it. In this case, the cover patch for the respective lower patch antenna element arrangement 5 for the lower frequency band at the same time forms the base plate for the patch antenna element arrangement 7, which is constructed on it, for the higher frequency band.

Starting with the patch antenna element arrangement 5, the patch antenna element arrangement 7 has a considerably physically smaller rectangular feed patch 7*a*, which is likewise once again provided with an H-shaped slot structure 13 with a central slot 13*a* and two parallel slots 13*b* which each extend beyond the central slot on both sides, so that the central slot 13*a* comes to rest parallel to and above the central slot 11*a* of the lower patch antenna element arrangement 5. The feed is likewise provided in the same way as for the lower patch antenna element arrangement 5, namely via a separate feed cable 15*b*, which is laid as symmetrically as possible in the same way from the central section of the central slot 13*a* in a V-shape or U-shape (curve 15'*b*) around one end of the parallel slot 11*b* to the center of the feed patch 13*a*, and from there as an extension of the central slot 13*a* to the edge of the feed patch 7*a*, and is routed from there to ground, that is to say to the reflector plate 1. In this case, the cable is routed to the feed patch from the opposite side of the reflector 1, that is to say from the opposite side compared to the feed cable 15*a*.

As can also be seen from the exemplary embodiment shown in FIG. 5*b*, a spur line 215*b* is likewise arranged parallel to the feed cable 15*b* in this case, starting on the curve 15'*b*, whose inner conductor 215"*b* bridges the slot 13*a* parallel to the inner conductor 115"*b* of the feed cable 15*b* and makes contact on the opposite side of the feed patch while, in contrast, the outer conductor 215'*b* on the spur line 215*b* makes contact with the patch on the same side as the outer conductor 115'*b* of the feed cable 15*b*.

The feed patch 7*a* which has been explained is held and anchored on the cover patch 5*b* via two column-like spacers 23 which are located offset and are likewise preferably located in the vertical plane formed by the central slots.

A physically smaller cover patch 7*b* is likewise formed, constructed on the feed patch 7*a* which has been mentioned, and is held opposite the feed patch 7*a* which supports it, via further spacers 24. The cover patch 7*b* is in this case shaped in the form of a frame in order to form a center opening 27, and is held via two lugs 29, which project at the sides from the frame 28 in the direction parallel to the central slots 11*a*, 13*a* located underneath, and are supported on the spacers 24. This rectangular shape of the top cover patch 7*b* results in the completely surprising effect of a considerable improvement in the matching (VSWR) and in considerably less sensitivity to water and rain, so that the housing cover (plastic housing etc.) covering the entire antenna arrangement results in the antenna being considerably less dependent on water.

According to the exemplary embodiment, the two feed cables 15*a*, 15*b* are passed in the longitudinal direction of the reflector 1 to a connecting end, at which two connections 35*a*, 35*b* are provided for the electrical feed for the two patch antenna element arrangements. In the illustration shown in FIG. 1, by way of example, this may be located on the right, in which case the corresponding feed cables 15*a* and 15*b* can end in corresponding plug connections on a closure plate, which closes off the reflector plate on the right and projects vertically upward to the reflector plane, for example adjacent to the two reflector edges 1'. However, both the feed cables 15*a*, 15*b* may just as well be joined together via a duplexer, so that only a single connection is required. A housing cover is mounted as a protective device over the entire arrangement, as normal, although this is not shown in any more detail.

For completeness, it should also be mentioned that—as can be seen in particular from the illustration in FIG. 5*a* although it is also shown in the cross-sectional illustration in FIG. 6—an electrically conductive bracket 37 with a rectangular cross section is provided on the top feed patch 7*a*, parallel to the associated central slot 13*a*, and its parallel web 37*a*, which is arranged parallel to the reflector plane, covers the central slot 13*a*, running parallel to it, and at a distance from it, and its vertical limb 37*b*, which supports it, is anchored on and makes mechanical contact with the associated feed patch 7*a*, on one edge face, parallel to the central slot 13*a*.

What is claimed is:

1. A patch antenna for operation in at least two frequency bands, having the following features:

a reflector, at least two patch antenna element arrangements, constructed on the reflector and/or arranged in front of the reflector, said at least two patch antenna element arrangements comprising a lower frequency band patch antenna element arrangement for a lower frequency band and a higher frequency band patch antenna element arrangement for a higher frequency band, the lower frequency band patch antenna element arrangements and the higher frequency band patch antenna element arrangement each having at least one active feed patch with an associated slot structure and a passive capacitively coupled cover patch, a base plate, the lower frequency band patch antenna element arrangements and the higher frequency band patch antenna element arrangement being located on the base plate, the cover patch of the lower frequency band patch antenna element arrangement forming the base plate for the passive cover patch of the higher frequency band antenna element arrangement, at least one feed patch including a slot arrangement having an H-shaped slot structure formed therein, and a feed cable arrangement, the slot structures being fed via said feed cable arrangement.

2. The patch antenna as claimed in claim 1, wherein the feed patch has an edge and the H-shaped slot structure includes a central slot and two parallel slots, the feed cable arrangement running at least approximately as an extension of the central slot, coming from the edge of the feed patch to the central slot, and is then laid around the respective end section of the closer of the two parallel slots to the associated central slot.

3. The patch antenna as claimed in claim 1, wherein the feed patch is fed at least approximately centrally or symmetrically.

4. The patch antenna as claimed in claim 1, wherein the feed cables arrangement feeding the feed patch are routed at least approximately centrally down over the edge of the feed patch to the reflector.

5. The patch antenna as claimed in claim 1, further including a conductive bracket with a rectangular cross section provided on the feed patch parallel to the slot structure, whose parallel web covers the slot structure, running parallel to it and at a distance from it, and a vertical limb thereof, which supports it, is mechanically anchored to and makes electrical contact with the associated feed patch, parallel to the slot structure on an edge face thereof.

6. The patch antenna as claimed in claim 1, further including a rectangular frame and wherein the cover patch which is located at the top is in the form of the frame, forming a center opening.

7. The patch antenna as claimed in claim 1, wherein the cover patch of the patch antenna element arrangement for the lower frequency band, which at the same time represents the base plate for the patch antenna element arrangement for the higher frequency band has in a central area thereof a recess in which the feed patch for the higher frequency band patch antenna element arrangement preferably disposed in an integrated manner.

8. The patch antenna as claimed in claim 7, wherein the feed patch of the higher frequency band patch antenna element arrangement is arranged at the same level as the cover patch for the lower frequency band.

9. The patch antenna as claimed in claim 1, wherein the cover patch of the patch antenna element arrangement for the lower frequency band, which at the same time represents the base plate for the patch antenna element arrangement for the higher frequency band defines in a central area thereof a depression in the form of a trough, in which the feed patch of the higher frequency band patch antenna element arrangement is disposed in an integrated manner.

10. The patch antenna as claimed in claim 1, wherein the frequency ratio of the patch antenna element arrangement for operation in the higher and lower different frequency bands is approximately 1:2.

11. The patch antenna as claimed in claim 1, further including spur lines for achieving improved decoupling for the patch antenna element arrangement tuned to said higher and lower frequency bands, said spur lines being connected in a length element for the respective feed line, parallel thereto.

12. The patch antenna as claimed in claim 1, wherein at least one of the patch antenna element arrangements has more than two patches per frequency band.

13. The patch antenna as claimed in claim 12, further including supports composed of nonconductive and/or dielectric material for holding the patches.

14. The patch antenna as claimed in claim 13, wherein the supports for the patches are arranged centrally with respect to the longitudinal or transverse phase, and are conductive.

15. The patch antenna as claimed in claim 12, wherein feed cables for the patches are connected by means of duplex filters to a resultant input.

16. The patch antenna as claimed in claim 1, wherein the antenna element arrangements are combined to form an array, and the patch antenna further includes additional antenna elements for the upper frequency band arranged and/or connected centrally between two patch antenna elements.

17. The patch antenna as claimed in claim 1, wherein the feed cables are provided with parallel-laid spur lines at least in their end area, whose inner conductors bridge the slot structure and make contact with the patch on the opposite side to outer conductors thereof.

18. The patch antenna as claimed in claim 1, wherein the base plate of the antenna element arrangement arranged lowermost and used for the lowest transmitted frequency band is provided by the reflector.

19. The patch antenna as claimed in claim 1, wherein the base plate of the antenna element arrangement arranged lowermost and used for the lowest transmitted frequency band is arranged in front of the reflector.

20. An antenna device comprising:

a reflector, at least two patch antenna element arrangements arranged in front of the reflector wherein the patch antenna element arrangements include a patch antenna element arrangement for a lower frequency band and a patch antenna element arrangement for a higher frequency band, each patch antenna element arrangement having at least one active feed patch with a H-shaped slot structure and a passive cover patch, the patch antenna element arrangements located on a base plate, the cover patch of the patch antenna element arrangement for the lower frequency band forming a base plate for the patch antenna element arrangement for the higher frequency band.

* * * * *